US005682830A

United States Patent [19]

Katou et al.

[11] Patent Number: 5,682,830

[45] Date of Patent: Nov. 4, 1997

[54] SEWING MACHINE

[75] Inventors: Yutaka Katou, Kariya; Hisaharu Goto, Nagoya; Seiichiro Hagino, Chiryu; Toshiyuki Nakai, Toyoake; Mikio Furuichi, Anjo; Akimitsu Kamatsuka, Chiryu; Suehiko Murata, Toyota, all of Japan

[73] Assignee: Aisin Seiki Kabushiki Kaisha, Kariya City, Japan

[21] Appl. No.: 579,164

[22] Filed: Dec. 27, 1995

[30] Foreign Application Priority Data

Dec. 28, 1994 [JP] Japan ..... 6-328145

[51] Int. Cl.[6] ..... D05B 87/02; D05B 49/00

[52] U.S. Cl. ..... 112/225; 112/302; 112/242

[58] Field of Search ..... 112/225, 302, 112/80.7, 242

[56] References Cited

U.S. PATENT DOCUMENTS

| | | | |
|---|---|---|---|
| 3,067,704 | 12/1962 | Pedersen | 112/225 X |
| 4,010,702 | 3/1977 | Miyamoto | 112/225 |
| 4,023,512 | 5/1977 | Miyamoto | 112/225 X |
| 4,198,915 | 4/1980 | Peterson et al. | 112/225 |
| 5,347,942 | 9/1994 | Thomas | 112/302 |
| 5,390,613 | 2/1995 | Shibata | 112/80.43 |

FOREIGN PATENT DOCUMENTS

| | | |
|---|---|---|
| 51-30046 | 3/1976 | Japan . |
| 51-42652 | 4/1976 | Japan . |
| 63-35268 | 7/1988 | Japan . |
| 6-154453 | 6/1994 | Japan . |

*Primary Examiner*—Paul C. Lewis

*Attorney, Agent, or Firm*—Oblon, Spivak, McClelland, Maier & Neustadt, P.C.

[57] ABSTRACT

A sewing machine includes a plurality of bobbins, thread guiding device, thread selecting device, a needle having an eye, a thread take-up lever having a thread receiving hole, thread taking-out device, movable thread hooking device, and thread letting-through device. The thread guiding device delivers a plurality of threads from the bobbins. The thread selecting device selects one of the threads. The thread taking-out device brings the selected thread adjacent to the eye of the thread. Simultaneously with the thread taking-out action of the thread taking-out device, the movable thread hooking device and the thread letting-through device co-operatively let the selected thread, being disposed between the thread take-up lever and the needle, pass through the thread receiving hole of the thread take-up lever via an opening of the thread receiving hole, and let the leading end of the selected thread pass through the eye of the needle.

5 Claims, 6 Drawing Sheets

SEWING MACHINE

BACKGROUND OF THE INVENTION

1. Field of the Invention

The present invention relates to a sewing machine. In particular, it relates to a sewing machine, which can selectively let one of a plurality of threads, for example, one of diversely colored threads, pass through an eye of a needle automatically, and which then can carry out sewing with the selected thread.

2. Description of Related Art

Embroidery usually comprises a plurality of diversely colored threads. Japanese Examined Patent Publication (KOKOKU) No. 63-35,268 (hereinafter referred to as "Reference No. 1") and Japanese Unexamined Patent Publication (KOKAI) No. 51-42,652 (hereinafter referred to as "Reference No. 2") disclose sewing machines, which can prepare such embroidery. Both of the sewing machines are characterized in that they are provided with an automatic thread letting-through function. The automatic thread letting-through function enables to selectively and exchangeably let one of a plurality of threads pass through an eye of a needle.

Japanese Unexamined Patent Publication (KOKAI) No. 51-30,046 (hereinafter referred to as "Reference No. 3") discloses a sewing machine, which is provided with an independent thread letting-through function.

The sewing machine disclosed in Reference No. 1 includes a thread holder which lets a selected thread pass through a thread take-up lever, and a thread passer which lets the thread pass through an eye of a needle. The sewing machine lets the thread pass through the thread take-up lever and the eye of the needle by sequentially operating the thread holder and the thread passer. However, the sewing machine applies sliding resistance to the thread, which is being passed through. The sliding resistance results from the thread paths. Thus, the sewing machine cannot stably feed the thread. Accordingly, the sewing machine cannot stably let the leading end of the thread pass through the eye of the needle by a predetermined length. When the sewing machine lets the leading end of the thread pass through the eye of the needle by a shortened length, the thread comes off from the eye of the needle. As a result, the sewing machine should carry out the thread letting-through operation again.

The sewing machine disclosed in Reference No. 3 includes a first clamper, a second clamper, and a hook. The first clamper clamps a thread, which a thread feeder feeds out, and drags the thread immediately in front a thread letting-through opening of a thread take-up lever, which is placed at a predetermined position. The second clamper waits immediately behind the thread take-up lever. Further, the second clamper clamps the thread, which comes out of the thread letting-through opening of the thread take-up lever, when it ascends. Furthermore, the second clamper drags the thread immediately in front of an eye of a needle, which waits at a predetermined position, when it descends. The hook waits immediately behind the eye of the needle, goes through the eye, hooks the thread which is immediately in front of the eye, and then retracts to let the thread pass through the eye. Thus, the sewing machine lets the thread pass through the thread take-up lever and the eye of the needle in different directions. Accordingly, the sewing machine should carry out giving and taking the thread between the first clamper and the second clamper. As a result, in the sewing machine, it is necessary for the first clamper, the second clamper and the hook to precisely follow their operational paths. Hence, the sewing machine has an extremely complicated construction.

The sewing machine disclosed in Reference No. 2 carries out the thread letting-through operation (i.e., letting a thread pass through a thread take-up lever, and leading the tread immediately before an eye of a needle) by means of air flow. Accordingly, the sewing machine includes a thread-suctioning pipe and a thread-leading pipe, which are adapted for the thread letting-through operation. However, similarly to the sewing machine disclosed in Reference No. 3, the sewing machine requires thread-giving-and-receiving means, which should precisely follow its operational path.

Additionally, in the sewing machine disclosed in Reference No. 2, the thread-leading pipe troubles the sewing operation. As a result, it is necessary to build the thread-leading pipe so as not to interfere with the needle. However, even if the thread-leading pipe can shunt, one can easily imagine that the thread comes off from the eye of the needle when the thread-leading pipe shunts.

SUMMARY OF THE INVENTION

It is therefore an object of the present invention to provide a sewing machine, which does not independently let one of a plurality of threads pass through a thread take-up lever and a needle, but which can readily and simultaneously let the thread pass through the thread take-up lever as well as the needle by means of simple arrangement.

An embodiment of the present invention can solve the problems of the conventional sewing machines, and carry out the object of the present invention. The preferred embodiment comprises:

- a plurality of bobbins delivering a plurality of threads;
- thread guiding means receiving leading ends of the threads, being delivered from the bobbins, and holding the leading ends by a predetermined length thereon;
- thread selecting means selecting freely one of the threads held on the thread guiding means;
- a needle having an eye;
- a thread take-up lever having a thread receiving hole, the thread receiving hole having an opening;
- thread taking-out means holding the leading end of the thread, being selected by the thread selecting means, and taking out the leading end adjacent to the eye of the needle;
- movable thread hooking means reciprocating in responsive to the thread taking-out action of the thread taking-out means, moving forward to hook a portion of the taken-out thread, being placed between the thread take-up lever and the needle, moving backward, and stopping at an intermediate position between the thread take-up lever and the needle, thereby giving tension to the thread and letting the thread pass through the thread receiving hole of the thread take-up lever; and
- thread letting-through means positioned adjacent to the eye of the needle when the thread taking-out means brings the leading end of the thread adjacent to the eye of the needle, and letting the leading end of the thread pass through the eye of the needle.

In the embodiment, the thread guiding means and the thread selecting means can be built integrally. The thread letting-through means can be either suctioning means or mechanical means. For instance, the suctioning means retrieves the leading end of the thread through the eye of the needle by means of air flow, which results from pneumatic pressure. The mechanical means hooks the leading end of the thread through the eye of the needle mechanically.

In the embodiment, the bobbins deliver a plurality of threads. The thread guiding means receives the leading ends of the threads by a predetermined length thereon. The thread selecting means selects one of the threads. The thread taking-out means holds the leading end of the thread, which is selected by the thread selecting means, and takes out the leading end adjacent to the eye of the needle. Then, the movable thread hooking means and the thread letting-through means cooperatively let the thread pass through the thread receiving hole of the thread take-up lever and the eye of the needle. The embodiment thus completes the thread letting-through operation.

Specifically, when the thread taking-out means takes out the thread, the movable thread hooking means reciprocates. When the movable thread hooking means advances, it hooks a portion of the taken-out thread, which is placed between the thread take-up lever and the needle. When the movable thread hooking means stops still, it spans the taken-up thread between the thread take-up lever and the needle in a zigzag manner. Thus, tension applies to the thread, and thereby the thread passes through the thread receiving hole of the thread take-up lever by way of the opening thereof.

Moreover, when the thread taking-out means brings the leading end of the thread in front of the eye of the needle, the thread letting-through means is on the opposite side with respect to the eye of the needle, and lets the leading end pass through the eye of the needle.

In accordance with the embodiment, the thread take-out means takes out the thread, and the movable thread hooking means and the thread letting-through means co-operatively let the thread pass through the thread receiving hole of the thread take-up lever and the eye of the needle. Thus, without being disturbed by the sliding resistance of the thread path and without precisely giving and taking the thread between the component members, it is possible to carry out the thread letting-through operation with ease.

The embodiment can further comprise thread drawing-out means. This thread drawing-out means can operate co-operatively with the movable thread hooking means, and capture the leading end of the thread, which is taken out by the thread taking-out means, by an extra complementary length.

In the embodiment, the thread taking-out means can include a rotary actuator, and a rotary arm. This thread taking-out means enables to simultaneously let the thread pass through the thread receiving hole of the thread take-up lever as well as the eye of the needle.

In the embodiment, the thread letting-through means can include a thread-end-piece sweeper, and an actuator for moving the thread-end-piece sweeper. Note that the thread-end-piece sweeper can be built integrally with the thread-letting-through means. This thread-end-piece sweeper enables to remove the trimmed thread-end-piece from underneath a cloth to above the cloth when a sewing operation is completed.

The embodiment can further comprise a thread trimmer. The thread trimmer includes a fixed edge, a thread guide, and a movable edge. The thread guide holds the thread above the movable edge and the fixed edge when the thread trimmer is stand-by. This thread trimmer can be disposed on a thread path, because it can reliably inhibit the thread from interfering with the movable edge and the fixed edge when the thread taking-out means takes out the thread and when the needle carries out sewing.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 6 illustrates a thread trimmer which is adapted for the preferred embodiment illustrated in FIG. 1, wherein:

DETAILED DESCRIPTION OF THE PREFERRED EMBODIMENTS

Having generally described the present invention, a further understanding can be obtained by reference to the specific preferred embodiments which are provided herein for the purpose of illustration only and are not intended to limit the scope of the appended claims.

A preferred embodiment of a sewing machine according to the present invention will be hereinafter described with reference to FIGS. 1 to 6.

Figure 1:
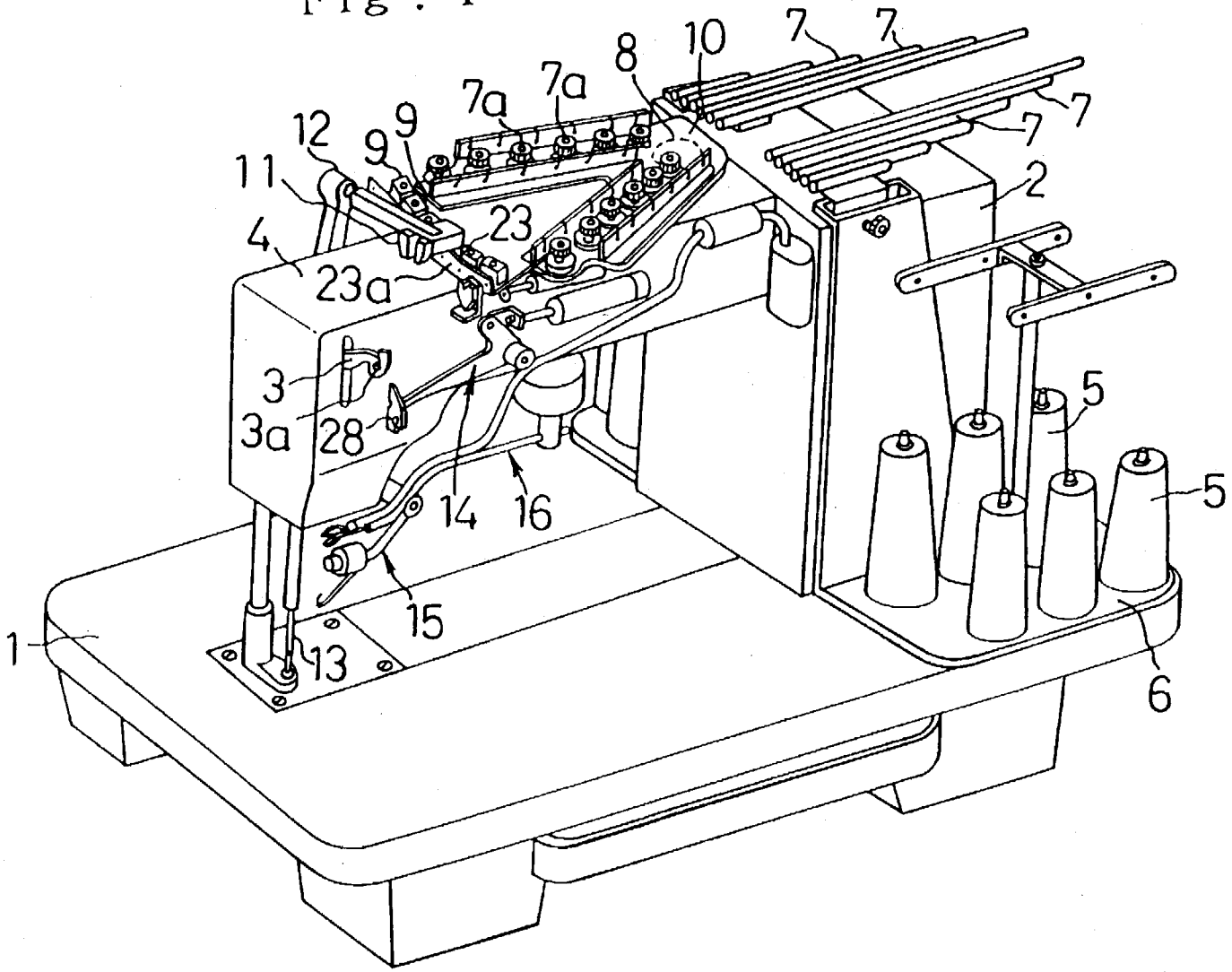
FIG. 1 is a perspective view for illustrating an overall construction of a preferred embodiment of a sewing machine according to the present invention.

As illustrated in FIG. 1, the preferred embodiment of the present sewing machine comprises a bed 1, a body 2, and an arm 4. An embroidery frame (not shown) is placed on the bed 1. A sewing motor is disposed in the body 2. A needle mechanism is disposed in the arm 4. The needle mechanism includes an arm shaft, and a thread take-up lever 3. The thread take-up lever 3 has a thread receiving hole 3*a*, which is provided with an opening.

Figure 2:
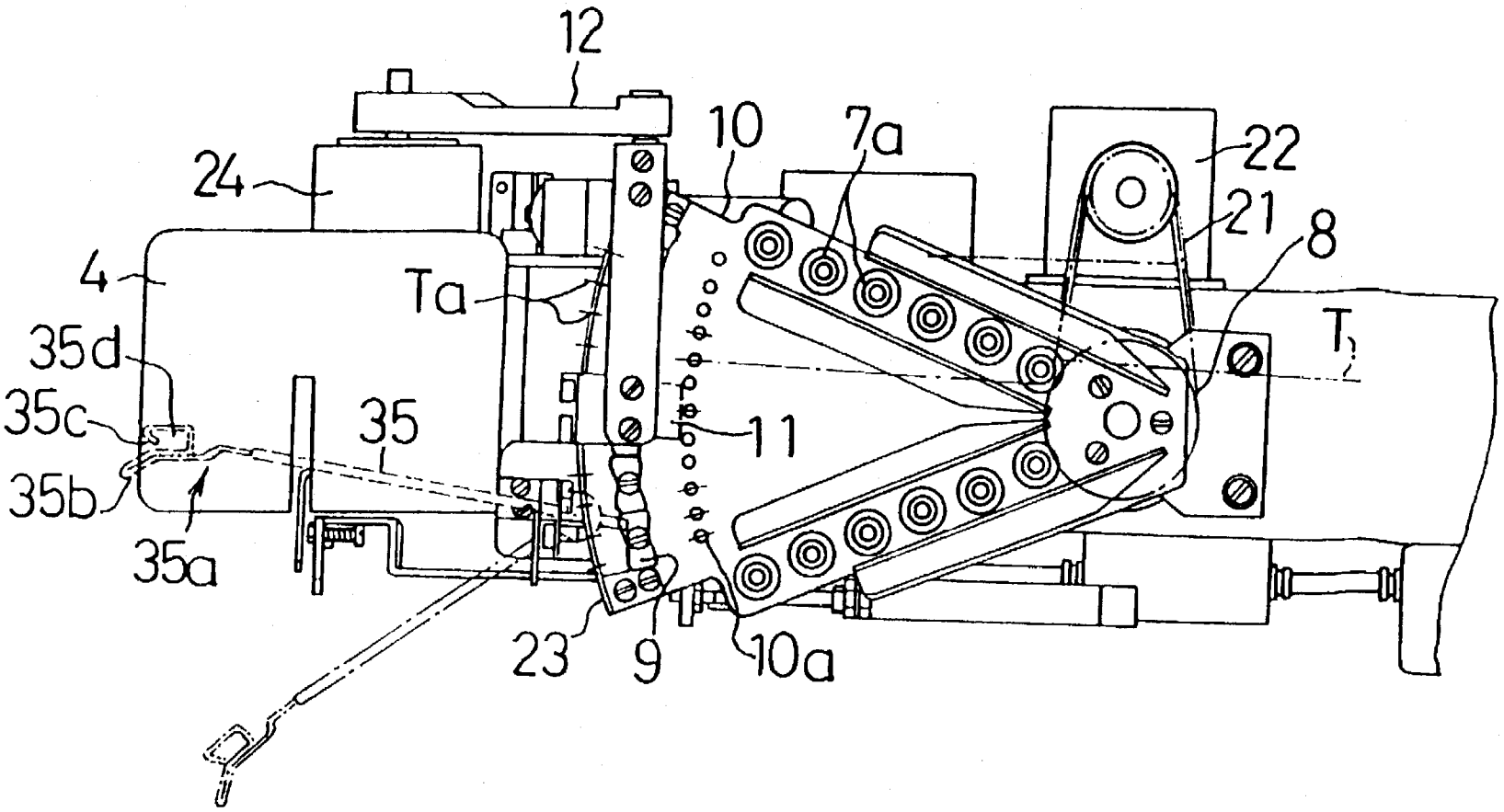
FIG. 2 is a plan view for illustrating a major portion of the preferred embodiment illustrated in FIG. 1.

The preferred embodiment of the present sewing machine further includes a bobbin table 6, a plurality of guide pipes 7, a rotary selector plate 10, a rotary arm 12, movable thread hooking means 14, thread letting-through means 15, and thread drawing-out means 16. The bobbin table 6 is constructed integrally with the bed 1, and is adapted for placing a plurality of bobbins 5 thereon. The guide pipes 7 are disposed on the top of the body 2 in the same quantity as that of the bobbins 5. Note that the rotary selector plate 10 constitutes both of the thread guiding means and the thread selecting means according to the present invention. The rotary selector plate 10 is rotatable about a pulley 8, and has a plurality of thread holders 9. As illustrated in FIG. 2, the thread holders 9 hold the leading ends "Ta" of the threads "T", which are delivered from the bobbins 5 via the guide pipes 7, by a predetermined projection length thereon. Note that the rotary arm 12 constitutes part of the thread taking-out means according to the present invention. The rotary arm 12 has a grip 11 at one of the opposite ends. The grip 11 grips the leading end "Ta" of one of the threads "T", which are held by the thread holders 9. The rotary arm 12 brings the grip 11 adjacent to an eye of a needle 13. The movable thread hooking means 14 is disposed in front of the arm 4, and can vertically reciprocatively swinging between an upper position and an intermediate position. The upper position is a rotary-selector-plate position, and the intermediate position is placed between the thread take-up lever 3 and the needle 13. The thread letting-through means 15 is disposed adjacent to the needle 13, and lets the leading end "Ta" of one of the threads "T" pass through the eye of the needle 13 by means of air-flow suction force. The thread drawing-out means 16 reciprocates co-operatively with the movable thread hooking means 14. Specifically, the thread drawing-out means 16 advances horizontally to an operator, and retracts horizontally therefrom.

As illustrated in FIG. 2, the rotary selector plate 10 is formed as a sector shape. The pulley 8 is disposed at the center of the sector shape, and is driven by a stepping motor 22 via a belt 21. Thus, the rotary selector plate 10 rotates about the pulley 8. A microcomputer (not shown) instructs the stepping motor 22 to rotate by a predetermined rotary angle, thereby positioning one of the thread holders 9, which holds the leading end "Ta" of the desired thread "T" thereon, at the grip 11 of the rotary arm 12. Accordingly, the rotary arm 12 can select the desired thread "T". For example, the grip 11 holds the leading end "Ta" of the desired thread "T" by means of pneumatic pressure or electromagnetic force. Note that a pneumatic circuit including a pneumatic source, or an electric circuit for operating the grip 11 is not shown.

Further, the rotary selector plate 10 is provided with a plurality of tension blocks 7*a*. The tension blocks 7*a* are aligned on the radial sides of the rotary selector plate 10, and are adapted for giving the threads "T", which are delivered from the guide pipes 7, tension required for sewing.

Figure 5:
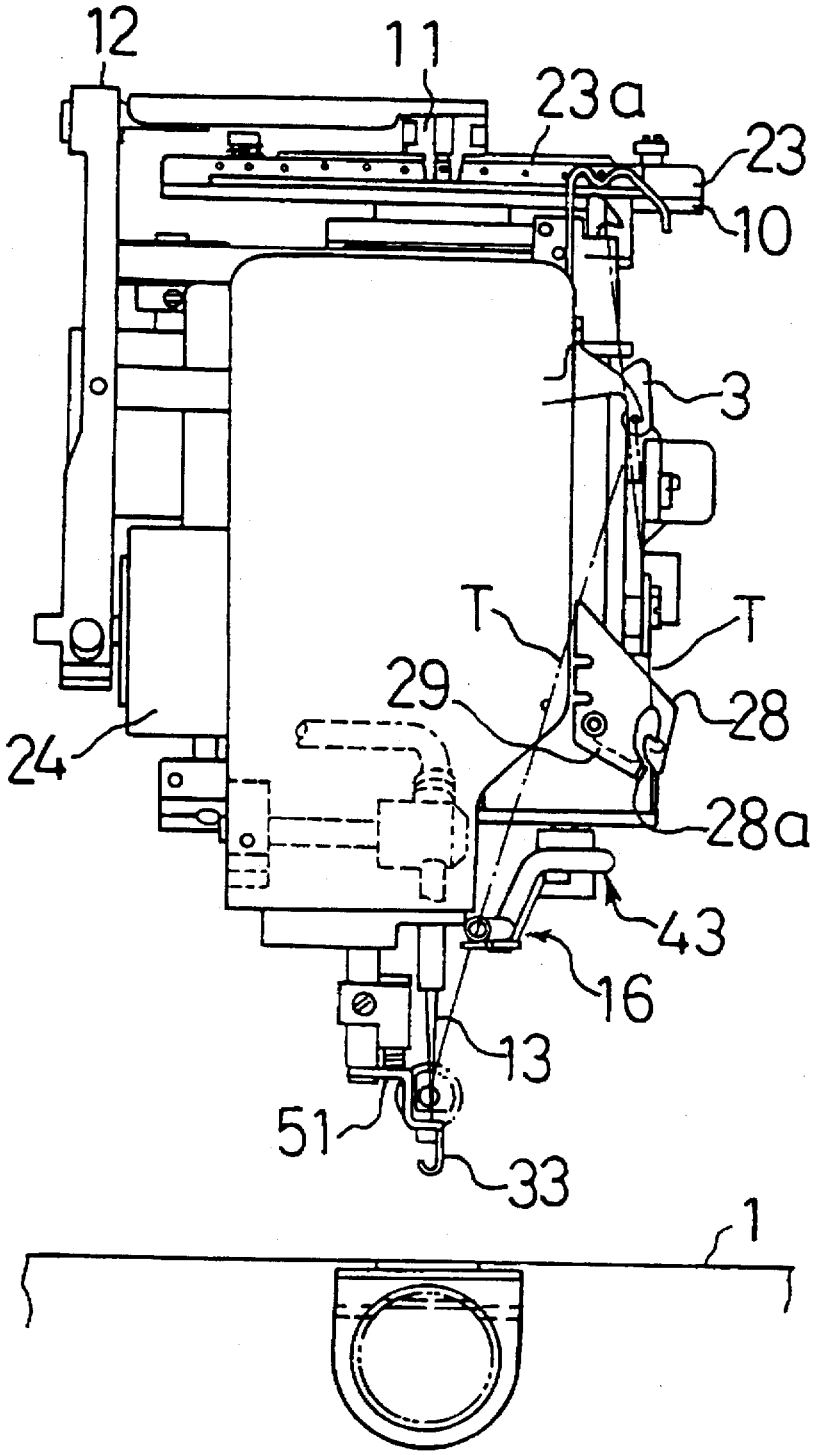
FIG. 5 is a left side view of the preferred embodiment illustrated in FIG. 1.

Furthermore, as illustrated in FIGS. 1 and 2, the rotary selector plate 10 is provided with a guide 23 on the arc side. As illustrated in FIGS. 1 and 5, the guide 23 has a plurality of through holes 23*a*. The thread holders 9 let the leading end "Ta" of the threads "T" pass through the through holes 23*a*, and securely project the leading ends "Ta" from the through holes 23*a* by a predetermined length.

Figure 6B:
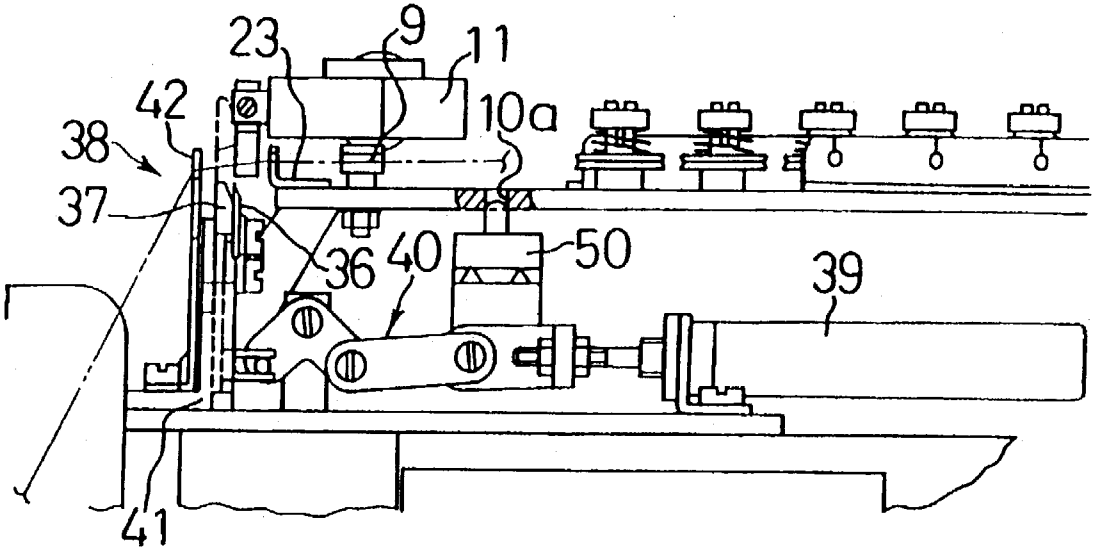
FIG. 6(B) is a front view of the thread trimmer.

Moreover, as illustrated in FIG. 2, the rotary selector plate 10 is provided with a plurality of rotary positioning holes 10*a* on the intermediate side. The rotary positioning holes 10*a* are arranged like an arc. As illustrated in FIG. 6(B), the rotary positioning holes 10*a* engage with a resilient projector 50.

Figure 4:
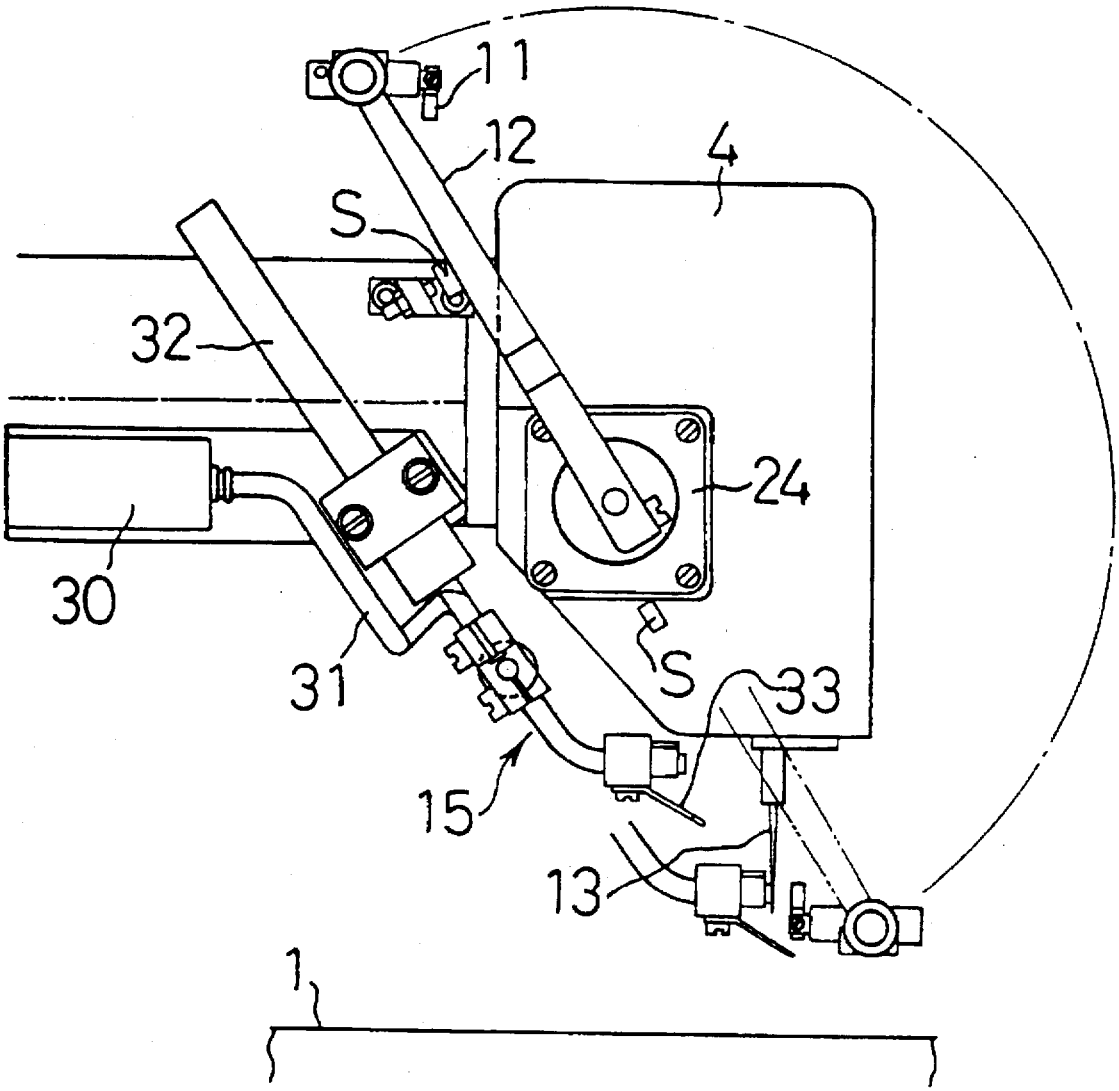
FIG. 4 is a rear view of the preferred embodiment illustrated in FIG. 1.

As illustrated in FIG. 4, the rotary arm 12 is fixed to a driving shaft of a motor 24 (i.e., a rotary actuator) at another one of the opposite ends. The motor 24 is disposed substantially at the center on the rear side of a head of the arm 4. As earlier described, the rotary arm 12 is provided with the grip 11 at one of the opposite ends. Accordingly, the grip 11 rotates like a semi-circle, thereby taking out one of the threads "T". Specifically, the grip 11 rotates from a first position to a second position. The first position is near the arc side of the rotary selector plate 10, where the thread holders 9 are arranged, or where the grip 11 faces the through holes 23*a* of the guide 23. The second position is where the grip 11 is adjacent to the eye of the needle 13. Note that stoppers "S", "S" regulates the range over which the rotary arm 12 rotates.

Figure 3:
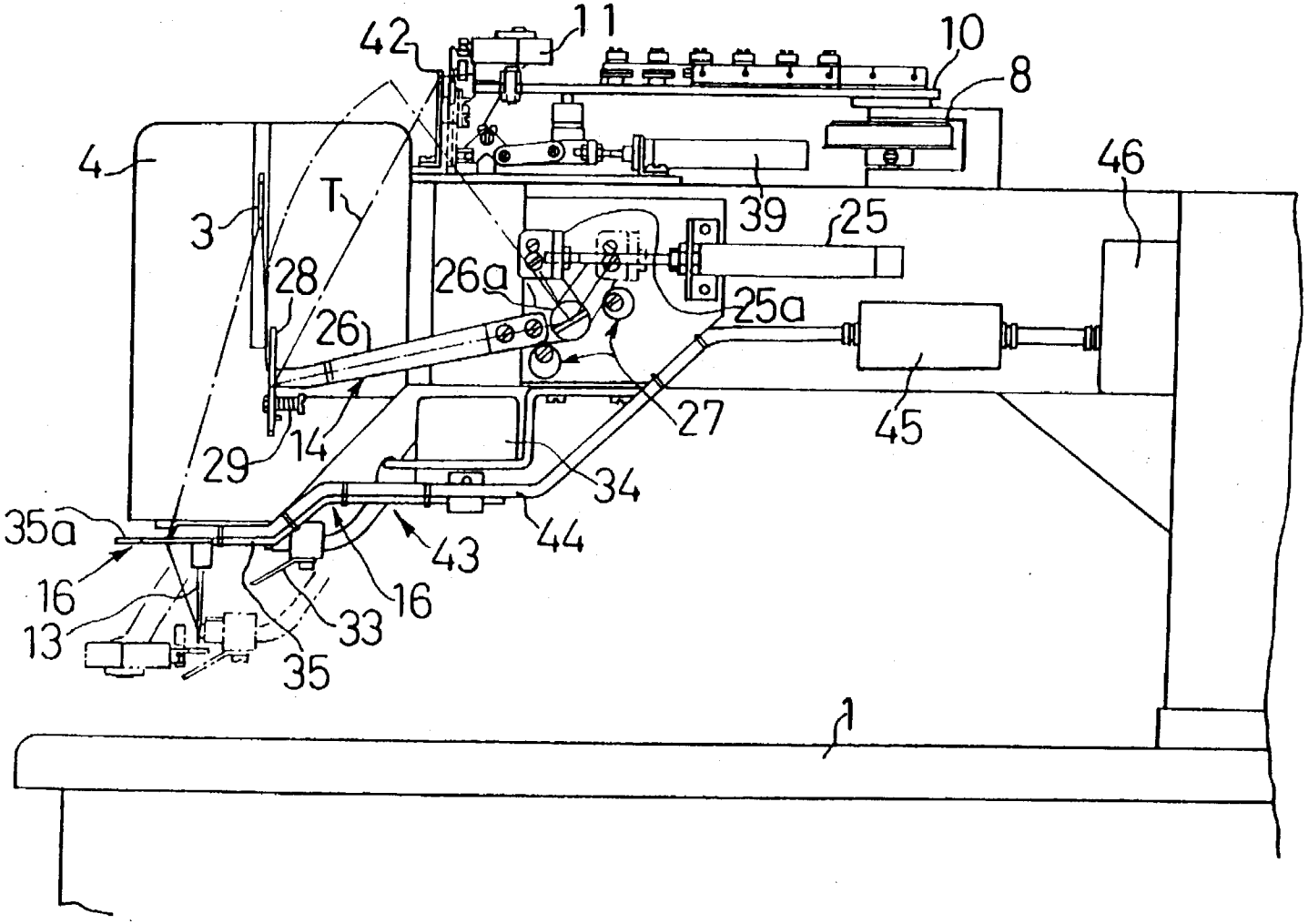
FIG. 3 is a front view of the preferred embodiment illustrated in FIG. 1.

As illustrated in FIG. 3, the movable thread hooking means 14 includes a virtually "L"-shaped lever 26, a pneumatic cylinder 25, a thread hooking piece 28, and stoppers 27. The "L"-shaped lever 26 has a supporting shaft 26*a*, which is disposed on the front side of a head of the arm 4. The pneumatic cylinder 25 has a piston 25*a*, which is connected to the shorter side of the "L"-shaped lever 26. The thread hooking piece 28 is disposed at the leading end of the longer side of the "L"-shaped lever 26. The stoppers 27 are disposed so as to contact with the shorter and longer sides of the "L"-shaped lever 26, respectively. As illustrated in FIG. 5, the thread hooking piece 28 has a groove 28*a*, and a thread take-up spring 29. The groove 28*a* engages with the selected thread "T". The thread taking-up spring 29 applies tension to the thread "T", which engages with the groove 28*a*.

The opening of the groove 28 is opened downward so as to receive the thread "T" when the longer side of the "L"-shaped lever 26 reciprocates backward. In other words, the thread hooking piece 28 captures the thread "T" when the longer side of the "L"-shaped lever 26 descends from the upper position to the intermediate position which is placed between the thread take-up lever 3 and the needle 13. Thus, the thread hooking piece 28 readily hooks the thread "T", which is taken out by the rotary movement of the rotary arm 12.

As illustrated in FIG. 4, the thread letting-through means 15 includes a suction generator 30, a suction pipe 31, and a pneumatic cylinder 32. The suction generator 30 supplies a negative pressure, which is produced, for example, by an exclusive suction source, to the suction pipe 31. The suction pipe 31 extends from the suction generator 30. The pneumatic cylinder 32 advances and retracts the suction pipe 31 to and from the needle 13. The leading end of the suction pipe 31 is placed adjacent to the eye of the needle 13. Thus, the suction pipe 31 lets the leading end "Ta" of the thread "T" pass through the eye of the needle 13 by means of air-flow suction force.

Moreover, the thread letting-through means 15 is provided with a thread-end-piece sweeper 33. The thread-end-piece sweeper 33 is disposed at the leading end of the suction pipe 31, and has a hook shape so that it appropriately hooks the thread "T".

As illustrated in FIG. 3, the thread drawing-out means 16, one of the features of this preferred embodiment, includes a frame member 35. The frame member 35 is driven by a solenoid 34. As illustrated with the dashed line of FIG. 2, the frame member 35 is under the head of the arm 4 when the present sewing machine carries out sewing. As illustrated with the solid line of FIG. 2, in responsive to the movement of the movable thread hooking means 14, the frame member 35 moves temporarily to the side of an operator when the present sewing machine carries out the thread letting-through operation. The thread drawing-out means 16 further takes out the thread "T", which is taken out by the rotary arm 12, by an extra complementary length.

As illustrated in FIG. 2, the frame member 35 is provided with a hook 35*a* at the leading end. The hook 35*a* is made of steel, and has leg pieces 35*b*, 35*c*. The leg pieces 35*b*, 35*c* forms an opening 35*d*. The opening 35*d* is formed below the thread-converging point where the thread "T", taken out by the rotary arm 12, converges, or where the thread "T" descends by gravity. Thus, the opening 35*d* holds the captured thread "T" therein even in sewing.

Figure 6A:
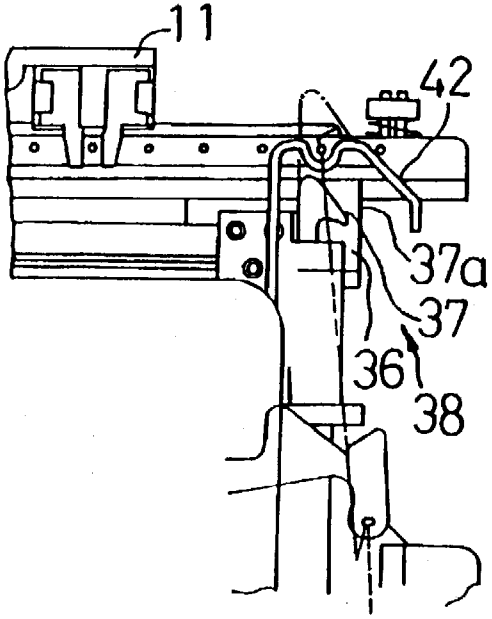
FIG. 6(A) is a thread side view of the thread trimmer.

Moreover, as illustrated in FIGS. 6(A) and 6(B), the head of the arm 4 is disposed under the arc side of the rotary selector plate 10, and is provided with a thread trimmer 38. The thread trimmer 38 includes a fixed edge 36, and a movable edge 37. The fixed edge 36 and the movable edge 37 move relatively to each other, thereby trimming the thread "T".

For instance, the thread trimmer 38 is disposed at the side end of the head of the arm 4 on the side of an operator. The movable edge 37 vertically crosses the path of the thread "T", which is delivered out of the through holes 23*a* of the guard 23. The movable edge 37 trims the thread "T" when descending.

Specifically, as illustrated in FIG. 6(A), the movable edge 37 forms an inclined surface 37*a* at the top to have a downward edge. The fixed edge 36 has an upward edge. When the thread trimmer 38 is stand-by, the movable edge 38 is below the through holes 23*a* of the guard 23, from which the threads "T" are delivered. Accordingly, when the thread trimmer 38 is stand-by, the movable edge 37 superimposes on the fixed edge 36. The movable edge 37 moves vertically by means of a driving mechanism. As illustrated in FIG. 6 (B), the driving mechanism includes a pneumatic cylinder 39, and an ascending-and-descending link mechanism 40. A guide supporter 41 extends vertically, and supports the movable edge 37. The ascending-and-descending link mechanism 40 is connected with the movable edge 37, thereby enabling the movable edge 37 to move vertically.

As illustrated in FIG. 6(B), a thread guide 42 is fixed, for example, to the guide supporter 41. As illustrated in FIG. 6(A), the thread guide 42 is placed between the fixed edge 36 and the through holes 23*a* of the guard 23 in the vertical direction. The thread guide 42 guides the thread "T" vertically. Specifically, in the sewing operation, the thread guide 42 guides the thread "T" above the movable edge 37 and the fixed edge 36. In the thread trimming operation, the movable edge 37 moves above the through holes 23*a*, and the thread guide 42 guides the thread "T" so as to slide on the inclined surface 37*a*. Thus, the thread guide 42 brings the thread "T" under the movable edge 37. Accordingly, when the movable edge 37 descends, the movable edge 37 and the fixed edge 36 hold the thread "T" between themselves, thereby trimming the thread "T".

The thus constructed thread trimmer 38 holds the thread "T" over the movable edge 37 and the fixed edge 36 by the thread guide 42 when it is stand-by. Thus, the thread guide 42 reliably inhibits the thread "T" from interfering with the movable edge 37 and the fixed edge 36 when the present sewing machine takes out the thread "T" with the rotary arm 12, and when the present sewing machine carries out the sewing operation. As a result, it is possible to inhibit the thread "T" from being trimmed accidentally.

In addition, as illustrated in FIG. 3, the preferred embodiment of the present sewing machine further comprises a vacuum cleaner 43. The vacuum cleaner 43 suctions the trimmed thread-end-pieces therein after the thread trimming operation. As illustrated in FIG. 3, the vacuum cleaner 43 includes a suction pipe 44, a suction force generator 45, and a trimmed-thread-end-pieces collector 46. The suction pipe 44 is integrated with the frame member 35 of the thread drawing-out means 16. The leading end of the suction pipe 44 faces the hook 35*a* of the frame member 35.

The thus constructed preferred embodiment of the present sewing machine carries out the thread selecting operation, the thread letting-through operation, the sewing operation, the thread trimming operation, and the trimmed-thread-end-pieces suctioning operation as hereinafter described.

When carrying out the thread selecting operation, an operator inputs an instruction for selecting a desired colored thread into a microcomputer (not shown) of the present sewing machine. Then, the present sewing machine rotates the rotary selector plate 10 by a predetermined rotary angle. The instruction is given, for example, by an absolute angle with respect to a datum angle. The data, concerning the relationship between the absolute angle, the driving angle of the stepping motor 22 and the thread "T" to be selected, have been written in a memory of the microcomputer in advance. When an operator designates one of the threads "T", the rotary selector plate 10 rotates about the pulley 8 by a specified angle from the datum angle, and aligns the thread holder 9, which holds the selected thread "T", with the grip 11. When the microcomputer gives the grip 11 an instruction to actuate, the grip 11 grips the leading end "Ta" of the selected thread "T", which projects from the through hole 23*a* of the guard 23. The present sewing machine thus completes the thread selecting operation.

When carrying out the thread letting-through operation, the present sewing machine rotates the rotary arm 12 like a semi-circle as illustrated with the alternate-long-and-short-dash line of FIG. 4. Specifically, when an operator instructs the present sewing machine to carry out the thread letting-through operation, the present sewing machine actuates the motor 24. The motor 24 rotates the rotary arm 12 to move the grip 11, which holds the leading end "Ta" of the thread "T", like a semi-circle. Thus, as illustrated in FIGS. 3 and 4, the rotary arm 12 brings the leading end "Ta" of the thread "T" adjacent to the needle 13. At the same time, as illustrated in FIG. 3, the thread "T", which is spanned between the thread take-up lever 3 and the grip 11, engages with the hook 35*a* of the frame member 35 of the thread drawing-out means 16, which is moving horizontally. Thus, the hook 35*a* clamps the thread "T" in the opening 35*d*.

The rotary selector plate 10 rotates synchronously with the movement of the rotary arm 12. Specifically, the rotary selector plate 10 rotates so that the through hole 23*a* of the guard 23, from which the leading end "Ta" of the selected thread "T" projects, is positioned over the thread take-up lever 3. Note that, at this moment, the grip 11 holds the leading end "Ta" of the selected thread "T". Then, the present sewing machine starts trying to carry out the sewing operation.

Further, a negative pressure is supplied to the pneumatic cylinder 25 (shown in FIG. 3) synchronously with the rotary movement of the rotary arm 12. The piston rod of the pneumatic cylinder 25 retracts. Accordingly, the "L"-shaped lever 26 of the movable thread hooking means 14 ascends from the intermediate position between the thread take-up lever 3 and the needle 13, and descends instantly. As illustrated in FIG. 5, when the "L"-shaped lever 26 descends, a portion of the thread "T", which is spanned between the thread take-up lever 3 and the rotary selector plate 10, goes into the groove 28*a* of the thread hooking piece 28, and simultaneously engages with the thread taking-up spring 29. Thereafter, the portion of the thread "T", which is spanned between the thread take-up lever 3 and the rotary selector plate 10, descends to the intermediate position between the thread take-up lever 3 and the needle 13. Note that the portion of the thread "T" keeps the engagement with the thread taking-up spring 29 during the descending. Thus, as illustrated in FIG. 3, the thread "T" is taken out in a zigzag manner, and tension is applied to the thread "T".

Furthermore, when the "L"-shaped lever 26 of the movable thread hooking means 14 descends, the frame member 35 of thread drawing-out means 16 swings to the side of an operator as illustrated with the solid line of FIG. 2. As a result, the thread drawing-out means 16 further takes out the portion of thread "T", which is taken out by the rotary arm 12 to span between the thread take-up lever 3 and the needle 13, in the horizontal direction. Thus, the frame member 35 captures the thread "T", which is taken out by the rotary arm 12, by an extra complementary taking-out length.

When the rotary arm 12 rotates, the microcomputer has already given the thread letting-through means 15 an instruction to carry out suctioning. A pneumatic pressure has been applied to the pneumatic cylinder 32 (shown in FIG. 4).

When the grip 11 of the rotary arm 12 is adjacent to the eye of the needle 13, the leading end of the suction pipe 31 is adjacent to the eye of the needle 13. In short, the suction pipe 31 moves from the stand-by position to the operational position. When the suction air generator 30 suctions air, the grip 11 releases the leading end "Ta" of the thread "T". Accordingly, the thread "T" passes through the eye of the needle 13, and the suction pipe 31 suctions the thread "T" by a predetermined length. Thus, the thread letting-through means 15 lets the thread "T" pass through the eye of the needle 13.

Thereafter, the suction pipe 31 goes away from the eye of the needle 13. The preferred embodiment of the present sewing machine then starts the sewing operation.

Thus, the thread drawing-out means 16 sufficiently secures the length, by which the suction pipe 31 sucks in the leading end "Ta" of the thread "T". Accordingly, it is possible to avoid letting the thread "T" faultily pass through the eye of the needle 13. Note that, even if the preferred embodiment of the present sewing machine is free from the thread drawing-out means 16, it is possible to avoid letting the thread "T" faultily pass through the eye of the needle 13 by securely taking out the thread "T" with the rotary arm 12 by a sufficient length.

The preferred embodiment of the present sewing machine carries out the sewing operation by known actions, for instance, by co-operatively actuating the thread take-up lever 3 and the needle 13 with a sewing motor.

As illustrated in FIG. 3, the preferred embodiment of the present sewing machine includes the thread-end-piece sweeper 33. The thread-end-piece sweeper 33 is adapted for expelling the thread "T", which is trimmed under a cloth, onto the cloth. The thread-end-piece sweeper 33 is fixed to the thread letting-through means 15, or it is built integrally with the thread letting-through means 15. As a result, it is possible to execute the thread letting-through operation as well as the thread sweeping operation, which the suctioning force carries out, by simply actuating the pneumatic cylinder 32 (shown in FIG. 4).

When the preferred embodiment of the present sewing machine completes the sewing operation by using the selected thread "T", it tries to carry out the subsequent thread trimming operation. As illustrated in FIGS. 6(A) and 6(B), it carries out the thread trimming operation with the thread trimmer 38. Specifically, the thread trimmer 38 applies the pneumatic pressure and the negative pressure alternately to the pneumatic cylinder 39 so as to ascend and descend the movable edge 37, thereby trimming the thread "T".

The suction pipe 44 of the vacuum cleaner 43 (shown in FIG. 3) sucks in the leading end "Ta" of the thread "T", which has been trimmed as described above. The trimmed-thread-end-pieces collector 46 then collects the trimmed thread-end-pieces therein.

The preferred embodiment of the present sewing machine repeats the above-described operations when it carries out the sewing operation by using a subsequently-selected colored thread.

As having been described so far, the preferred embodiment of the present sewing machine can complete the thread letting-through operation without independently letting the thread "T" pass through the thread take-up lever 3 and the eye of the needle 13, and without applying the sliding resistance, which results from the thread paths, to the thread "T". To put it differently, the preferred embodiment completes the thread letting-through operation by simplifying holding the leading end "Ta" of the selected thread "T" and taking out the leading end "Ta" adjacent to the eye of the needle 13. Thus, the preferred embodiment hardly requires to carry out the thread-giving-and-receiving operation between the thread take-up lever 3 and the needle 13, and accordingly has an extremely simplified construction.

Further, contrary to the conventional sewing machine disclosed in Reference No. 2, the rotary selector plate 10 of the preferred embodiment of the present sewing machine is not adapted for disposing a plurality of bobbins thereon. Accordingly, the preferred embodiment can adequately deal with the increment of the number of colored threads by providing extra tension blocks 7*a*.

Furthermore, in the preferred embodiment of the present sewing machine, the exclusively provided hydraulic oil source, or suction air source actuates the suction air generator 30, or the pneumatic cylinders 25, 32 and 39. It is possible to utilize the rotation of the sewing motor, which is not subjected to any load, to produce the pneumatic pressure or the negative pressure for actuating the suction air generator 30, or the pneumatic cylinders 25, 32 and 39.

Moreover, the preferred embodiment of the present sewing machine can comprise modified thread taking-out means. For example, the modified thread taking-out means can be a mechanism. Such a mechanism moves along a groove, which is formed around the head of the arm 4, and can transfer a thread when it moves from the top of the head of the arm 4 to the bottom thereof along the groove.

Having now fully described the present invention, it will be apparent to one of ordinary skill in the art that many changes and modifications can be made thereto without departing from the spirit or scope of the present invention as set forth herein including the appended claims.

What is claimed is:

1. A sewing machine, comprising:

a plurality of bobbins delivering a plurality of threads having leading ends;

thread guiding means for receiving the leading ends of the threads, being delivered from said bobbins, and holding the leading ends by a predetermined length on said thread guiding means;

means for selecting one of the threads held on said thread guiding means;

a needle having an eye;

a thread take-up lever having a thread receiving hole, the thread receiving hole having an opening;

thread taking-out means for holding the leading end of the thread, being selected by said thread selecting means, and for taking out the leading end to a position adjacent to the eye of said needle;

movable thread hooking means reciprocating in response to the thread taking-out action of said thread taking-out means, for moving forward to hook a portion of the taken-out thread, said portion being placed between said thread take-up lever and said needle, for moving backward, and for stopping at an intermediate position between said thread take-up lever and said needle, said movable thread hooking means thereby giving tension to the thread and letting the thread pass through the thread receiving hole of said thread take-up lever; and threading means positioned adjacent to the eye of said needle when said thread taking-out means brings the leading end of the thread adjacent to the eye of said needle, and threading the leading end of the thread through the eye of said needle.

2. The sewing machine according to claim 1 further comprising thread drawing-out means operating co-operatively with said movable thread hooking means and capturing the leading end of the thread which is taken out by said thread taking-out means, for drawing out the thread by an extra complementary length.

3. The sewing machine according to claim 1, wherein said thread taking-out means includes a rotary actuator, and a rotary arm, the rotary actuator having a driving shaft, and disposed in a head of the sewing machine, the rotary arm having opposite ends, one of the ends being provided with a grip gripping the leading end of the thread selected by said thread selecting means, another one of the ends being fixed to the driving shaft of said rotary actuator, the rotary arm being driven by said rotary actuatory to swing the grip in an arc between two positions, one of the positions disposed where said thread selecting means holds the leading end of the selected thread, another one of the positions disposed adjacent to the eye of said needle.

4. The sewing machine according to claim 1, wherein said threading means includes a thread-end-piece sweeper, and an actuator for moving the thread-end-piece sweeper, the thread-end-piece sweeper displacing between a stand-by position and an operating position by the actuator, the stand-by position disposed on one of the sides of vertical path of said needle, the operating position disposed on another one of the sides, the thread-end-piece sweeper held at the stand-by position by the actuator when said needle carries out sewing, and moved to the operating position by the actuator to remove a thread-end-piece, being trimmed and loaded on said needle, when said needle completes sewing.

5. The sewing machine according to claim 1 further comprising a thread trimmer disposed at a position where said thread guiding means holds the thread, being selected by said thread selecting means, the thread trimmer including a fixed edge, a thread guide, and a movable edge, the fixed edge disposed under the thread, the thread guide disposed above the fixed edge and holding the thread, the movable edge sliding vertically with respect to the fixed edge, substantially superimposing on the fixed edge when the movable edge is stand-by, and ascending above the thread, being held by the thread guide, to bring the thread downward, and then descending to trim the thread co-operatively with the fixed edge when the movable edge is operational.

* * * * *